US007990263B2

(12) United States Patent
Morrell

(10) Patent No.: US 7,990,263 B2
(45) Date of Patent: Aug. 2, 2011

(54) VECTOR-BASED HARBOR SCHEDULING

(75) Inventor: David C. Morrell, Friendswood, TX (US)

(73) Assignee: Beatty Street Properties, Inc., Deer Park, TX (US)

( * ) Notice: Subject to any disclaimer, the term of this patent is extended or adjusted under 35 U.S.C. 154(b) by 143 days.

(21) Appl. No.: 11/529,619

(22) Filed: Sep. 28, 2006

(65) Prior Publication Data

US 2008/0079608 A1 Apr. 3, 2008

(51) Int. Cl.

| | |
|---|---|
| ***G08B 1/08*** | (2006.01) |
| *G08B 23/00* | (2006.01) |
| *G08B 21/00* | (2006.01) |
| *G08G 1/123* | (2006.01) |

(52) U.S. Cl. ..... 340/539.13; 340/984; 340/988; 340/540

(58) Field of Classification Search ..... 340/984, 340/988, 540, 539.13

See application file for complete search history.

(56) References Cited

U.S. PATENT DOCUMENTS

| | | | | |
|---|---|---|---|---|
| 4,070,560 | A * | 1/1978 | Blanyer | 377/9 |
| 4,071,845 | A | 1/1978 | Gross | |
| 4,590,569 | A | 5/1986 | Rogoff et al. | |
| 5,404,135 | A | 4/1995 | Janex | |
| 5,719,771 | A * | 2/1998 | Buck et al. | 455/456.5 |
| 5,754,429 | A * | 5/1998 | Ishihara et al. | 701/200 |
| 6,124,810 | A * | 9/2000 | Segal et al. | 340/994 |
| 6,249,241 | B1 | 6/2001 | Jordan et al. | |
| 6,611,757 | B2 | 8/2003 | Brodie | |
| 6,658,349 | B2 * | 12/2003 | Cline | 701/207 |
| 6,801,907 | B1 * | 10/2004 | Zagami | 707/3 |
| 6,816,069 | B2 * | 11/2004 | Quigley | 340/521 |
| 7,286,914 | B2 * | 10/2007 | Cerchione et al. | 701/21 |
| 7,483,672 | B2 * | 1/2009 | Hart et al. | 455/12.1 |
| 2003/0195699 | A1 * | 10/2003 | Jones | 701/201 |
| 2004/0030496 | A1 * | 2/2004 | Brodie | 701/213 |
| 2004/0254985 | A1 * | 12/2004 | Horstemeyer | 709/205 |
| 2005/0197891 | A1 * | 9/2005 | Intihar | 705/13 |
| 2006/0068812 | A1 * | 3/2006 | Carro et al. | 455/456.3 |
| 2006/0235739 | A1 * | 10/2006 | Levis et al. | 705/9 |
| 2006/0282214 | A1 * | 12/2006 | Wolterman | 701/208 |

FOREIGN PATENT DOCUMENTS

| | | | |
|---|---|---|---|
| KR | 10-2001-0060021 | * | 7/2001 |
| KR | 10-2004-0070847 | * | 8/2004 |

* cited by examiner

*Primary Examiner* — George A Bugg
*Assistant Examiner* — Jack Wang
(74) *Attorney, Agent, or Firm* — Jennifer S. Sickler; Gardere Wynne Sewell LLP

(57) ABSTRACT

A method of optimizing the scheduling of ships entering and leaving a harbor, the method comprising the steps of:

a. Combining information from an automated identification system about each ship with scheduling information about each ship from a dispatching system to produce a combined ship ID/schedule for each ship;
b. Tracking the latitude and longitude of each ship using GPS to produce tracked latitude and longitude of each ship;
c. Comparing the tracked latitude and longitude of each ship to existing maps of the harbor; and
d. Continually comparing the ID/schedule for each ship with the tracked latitude and longitude of each ship.

The alerts are sent whenever the tracked latitude and longitude of each ship does not match the expected latitude and longitude of each ship at a given time. The method tracks and records whenever a pilot embarks or disembarks from a ship.

6 Claims, 5 Drawing Sheets

VECTOR-BASED HARBOR SCHEDULING

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENTIAL LISTING

Not Applicable

BACKGROUND OF THE INVENTION (1) Field of the Invention

This invention relates to systems and processes for transmission or reception of radio wave energy for obtaining or utilizing information (using radio wave transmitters or receivers), as to an object. It also relates to using transponders for navigation, and to data processing using GPS.

(2) Description of the Related Art

U.S. Pat. No. 4,071,845 discloses a harbor radio navigation system wherein harbor buoys transmit identification signals, each on a unique carrier frequency which identifies that particular buoy. Each buoy is shown on a harbor chart. This patent discloses nothing about how to locate and track the paths of the ships.

U.S. Pat. No. 4,590,569 discloses a navigation system including an integrated electronic chart display. The system uses an on-board Loran or Decca apparatus and an on-board object detecting equipment such as a radar or sonar apparatus. The system further includes an on-board vessel position computer which operates in response to observed Loran time differences, stored data from an initial calibration, and Loran grid offset data from an on-shore monitor system to compute a current or present position fix in longitude and latitude whereupon the computer causes a predetermined electronic chart to be displayed, being generated from a plurality of electronic charts stored in the form of digital files in memory. The selected chart, together with the present position of the ship, is displayed along with pre-selected alpha-numeric indicia of data relating to bearings, way points, ranges, "time to go", etc., also generated in accordance with the computed vessel position. Radar target returns of the local land mass and other stationary moving targets are additionally received by the ship's radar, and the radar image of the target echoes is next referenced to and superimposed on the electronic chart. However, this patent is concerned with strictly collection and display of data on-board a ship, but discloses nothing about the collection and display of data for onshore computers.

U.S. Pat. No. 5,404,135 discloses a sea navigation control process. The ships are equipped to transmit data about their speed, heading and position, which are displayed on a panoramic screen fitted on all ships and in the control center. The control center has priority access to this common channel to send general interest messages or special messages to all or some of the equipped ships. However, this patent does not disclose anything about 1) coordinating available pilots with ships that they are licensed to pilot, and 2) coordinating available docks with ships that need to be docked, and that can be serviced properly at the available docks.

U.S. Pat. No. 6,249,241 discloses a marine vessel traffic system that includes a radar harbor surveillance sensor, and a computer and display system that monitors marine harbor traffic, provides advisories to vessels in areas selected by the system operators, and provides the operators of the system with an early warning of unacceptable traffic conflicts in the harbor. It documents incidents and traffic conditions for the Coast Guard or other waterway authorities, but does not disclose giving selective access to any of this information to selected civilians onshore who have an interest in selected vessels.

U.S. Pat. No. 6,611,757 discloses a global positioning system ("GPS") tag system that uses a combination of GPS signals from GPS satellites, and RF samples of the GPS signals, to determine the position of an object. This patent also mentions that the U.S. Coast Guard "has addressed the need for situational awareness on the waterways through the Ports and Waterways Safety System (PAWSS), Vessel Traffic Services (VTS), and the Automated Identification System ("AIS") transponder. Any AIS equipped vessel returns identification, location, course and speed data through the VTS to the Vessel Traffic Center (VTC) which displays the waterway traffic situation." However, this patent does not disclose using the AIS transponder as part of a system to give selective access to the location, size, and speed of a selected vessel to selected civilians onshore who have an interest in the selected vessel.

BRIEF SUMMARY OF THE INVENTION

The method of the present invention combines pilot dispatch software ("PDM") and AIS, and applies the visual aid of Global Positioning and ships' information with AIS and the organization of harbor traffic synchronized by pilot dispatch software. Accuracy of harbor scheduling is enhanced with added information provided by AIS.

DETAILED DESCRIPTION OF THE INVENTION

Figure 1:
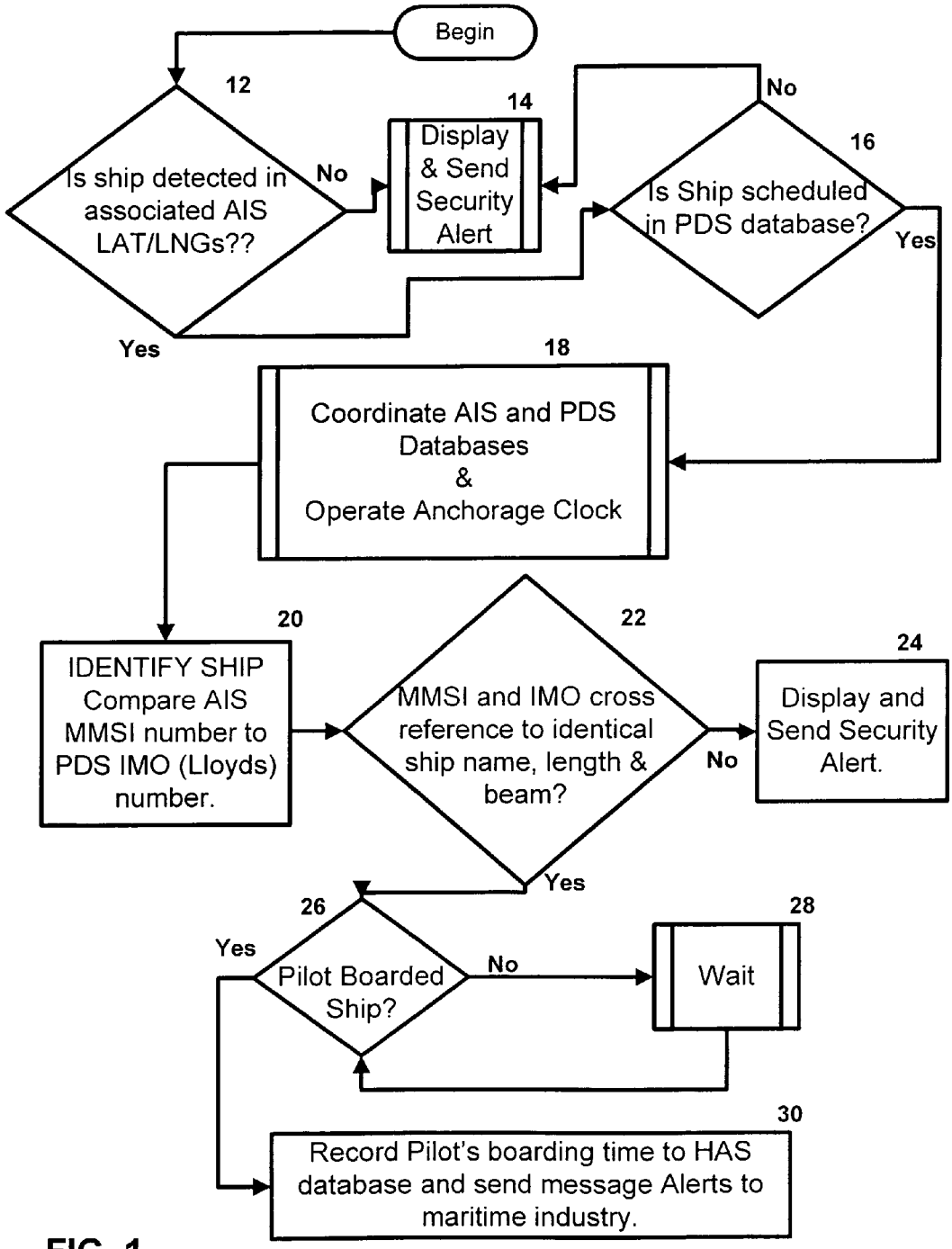
FIG. 1 is a flowchart showing the steps of the method of the present invention from the time the ship arrives at anchorage, until a pilot boards the ship.

The software of the present invention builds on a combination of two existing technologies: 1) pilot dispatch software ("PDM") and 2) automated identification systems (AIS) that use self organizing time division multiple access (STDMA).

Existing Pilot Dispatch Software

The PDM allows a person assigned to the job of dispatcher to assign pilots to 1) ships arriving, inbound into a harbor, 2) ships sailing, outbound from the harbor, and 3) ships shifting from dock to dock. The PDM receives as input from the dispatcher an order from a shipping agent to move a ship.

The PDM receives as inputs from the dispatcher:

- Time of Arrival of ship (arrival from sea)
- Time of Sailing of ship (departure of ship to sea)
- Time of ship Shifting (dock to dock movement)
- Ship Name
- Lloyds Number (unique identifier from International Maritime Organization)
- Confirmation of ship length, beam, and draft from Lloyds Ships Database
- Confirmation of ship length, beam and draft from the Houston Pilots Ships Database (more accurate than Lloyds and now used as default)
- Draft
- Sailing from (i.e., Sea, Dock)
- Sailing to (i.e., Dock, Sea)
- Heading (i.e., Port, Starboard)
- Gross Tonnage
- Length
- Beam
- Pilot boarding time (Ship ready to move)
- Pilot off time
- Point Passing (designated point on Ship Channel used as waypoint)
- Underway time
- Assigned pilot
- Moored Time
- Notes
- Tug Type(s) Assigned (Tug Matrix)
- Agent Name PDM provides the dispatcher

- Time ordered sequence of ships awaiting Pilots
- Time ordered sequence of ships with boarded Pilots
- Pilot availability according to shift rotation. (Pilot turn)
- Pilot certification of ship type (Is Pilot certified to move ship?)
- Notify dispatcher to alert Pilot of upcoming job.
- Notify dispatcher of scheduled ships with beams over 120' of beam going to City dock area cannot Moore opposite sides of the channel. (Large ships moored opposite of each other in city dock area will block large ships moving in or out of Turing basin.)
- Time stamp of record and record update
- Hire Extra Pilot according to off rotation. Current availability of Pilots on duty is exhausted and Pilots from the off shift rotation are hire to move
- Ship Restrictions. (ships limits due to size, type, and time of day)
- History of ship movements on the Houston Ship Channel
- History of dock status on the Houston Ship Channel.
- Dock Status
- Dock conflict resolution
- Dispatcher Log
- Dispatcher Work Sheet (Worksheet provides dispatcher ability to record new orders and changes in times where keyboard entry may be too slow. Also, provides recent history in case recent record is damaged and database repair will not fix. Worksheet data can be a backup between database backups).

The collection of all this data is known as the "scheduling information". The PDM then matches the ship with an available dock in the harbor. The PDM also reviews the list of available pilots, determines which of the available pilots are licensed for the type of the ship, selects a pilot, based on certification, and based on shift rotation, and assigns the selected pilot to the ship.

The PDM shares the scheduling information via the internet with maritime services that include tugboats, mooring, port operations, port police, coast guard, docks (terminals), U.S. Customs, planning services, ministries, agents and more.

Existing Automated Identification Systems

The existing AIS systems are used by ships and vessel traffic systems (VTS) principally for identification of vessels at sea. AIS systems help to resolve the difficulty of identifying ships when not in sight (e.g., at night, in fog, in radar blind arcs, shadows, or at distance) by providing a means for ships to exchange identification, position, course, speed and other ship data with all other nearby ships and VTS stations.

AIS transponders automatically transmit the position and velocity of the ship via a VHF radio built into the AIS. The position and velocity originate from the ship's GPS or, if that fails, from an integral GPS receiver. The AIS transponder also receives heading information from the ship's compass and transmits this at the same time. Other information, such as the vessel name and VHF call sign, is entered into the shipboard AIS equipment when installing the AIS equipment. The signals are received by AIS transponders fitted on other ships or on land based systems, such as VTS systems.

The AIS systems visually display the positioning and speed of a ship on a raster map via VHF. The transmitted AIS information and ship location can be used to site potential congestion of harbor ship and other vessel traffic. Before a ship can enter a U.S. harbor it must be transmitting AIS information and recognized by Coast Guard AIS receivers.

In order to ensure that the VHF transmissions of different AIS transponders do not occur at the same time they are time multiplexed. In order to make the most efficient use of the bandwidth available, vessels which are anchored, or are moving slowly, transmit less frequently than those that are moving faster or are maneuvering. The update rate for fast maneuvering vessels is similar to conventional marine radar. The time reference is derived from the GPS system.

A typical AIS transponder sends the following data every two minutes:

- Rate of turn—right or left, 0 to 720 degrees per minute
- Speed over ground—0.1 knot resolution from 0 to 102 knots
- Position accuracy
- Longitude—to $1/10000$ minute and Latitude—to $1/10000$ minute
- Course over ground—relative to true north to 0.1 degree
- True Heading—0 to 359 degrees from eg. gyro compass
- Time stamp—UTC time accurate to nearest second when this data was generated In addition, the following data is broadcast every 6 minutes:

- MMSI number—vessel's unique identification
- IMO number
- Navigation status—"at anchor", "under way using engine (s)", "not under command", etc
- Radio call sign—international radio call sign assigned to vessel
- Name—Name of vessel, max 20 characters
- Type of ship/cargo
- Dimensions of ship—to nearest meter
- Location of positioning system's (e.g. GPS) antenna onboard the vessel
- Type of positioning system—usually GPS or DGPS Draught of ship—0.1 meter to 25.5 meters
Destination—max 20 characters
ETA (estimated time of arrival) at destination—UTC month/date hour:minute Though AIS allows for ship positioning and speed, it has no provisions for harbor scheduling information once it has arrived at the harbor. Its only information for scheduling is the destination name of the harbor.

The Present Invention: A Combination of the PDM and the AIS

The disclosure of U.S. Pat. No. 6,249,241 regarding AIS information is incorporated herein by this reference. In that patent it is referenced as "vessel identification data". The disclosure of U.S. Pat. No. 6,611,757 regarding AIS information, shown in the first paragraph of its "Description of the Related Art", is incorporated herein by this reference. The disclosure of U.S. Pat. No. 6,611,757 regarding the use of GPS and DGPS, and specifically its "GPS tag system 10", is incorporated herein by this reference.

Due to its Microsoft SQL design, the method of the present invention is adaptable for using other maritime service scheduling information. The present invention produces a NOAA raster map which we vectorize ourselves to produce ETAs (Estimated Times of Arrivals) between LAT/LNGs. We vectorize the raster map by recording LAT/LNGs along the course of harbor and store them in a SQL table. As the ship travels the course of the harbor the LAT/LNGs stored in the SQL table are converted to distance, added together and mulitplied by the time recorded from AIS to produce the ETA. The compared coordinates adjust to the map scaling and vector points to improve the accuracy of a ship's true position and heading. Although existing AIS systems do not guarantee the accuracy of the position data, the vector map of the present invention is accurate to one meter. Once a sample for the incoming AIS LAT/LNG data is tracked, the vectors in the map are used as the default coordinate if a rogue LAT/LNG is suspected.

The method of the present invention displays the ship icons using 60 different ship icons to display directions, and using a different icon for each direction. The color of the ship icon indicates its status:

Moving=Green
Stopped=Red
In Anchorage=Yellow
Moored=Blue

Additionally, the following static information is displayed in an on-screen display box:

List of Selected Ships seen by AIS
- Name from pilot dispatch software database
- MMSI from AIS
- Call Sign from AIS
- COG from AIS
- SOG from AIS
- Status from AIS
- Destination from pilot dispatch software database
- Last Update from AIS When a user clicks on one of the ship Icons, "balloon" Information appears on the screen, giving:

Name from pilot dispatch software database
Status from AIS
Speed from AIS
Heading—Port or Starboard from the pilot dispatch software database
Scheduling Information from the pilot dispatch software database
History (15 days) from the pilot dispatch software database The method of the present invention incorporates key time references. Each ship that is recognized by the method of the present invention is assigned one of three clocks: anchorage, travel, and dock. Each clock runs and coordinates with a master clock referenced to the pilot dispatch software.

Anchorage Clock

When the ship reaches anchorage and is detected by the AIS anchorage waypoint, the ship is assigned an anchorage clock. The clock will continue to run until AIS detects that the ship has left the assigned anchorage waypoint latitude and longitude ("LAT/LNGS"). The anchorage clock keeps a time track as to how long the ship is sitting in the anchorage area. The AIS feed triggers the pilot dispatch software, time stamps the pilot dispatch database, and alerts the dispatchers that the ship has arrived at anchorage. The pilot dispatch software then alerts the dispatcher that he will have eight hours to assign the ship a pilot and to move the ship into harbor. The anchorage clock is used to trigger updated alerts as to the time the ship is spending in anchorage. A history of anchorage time is archived, and is used to determine which ships have a tendency for longer anchorage times. This history is intended to improve movements of ships that seem to develop a pattern of longer anchorages. As the ship leaves anchorage, another time stamp is added to the pilot dispatch software database.

Travel Clock

When the ship leaves the anchorage waypoint, the anchorage clock is removed, and a travel clock is assigned to the ship. The travel clock is used to verify the AIS calculated speeds by comparing them with the pilot dispatch software database, using the pilot's "on" time and destination. Using AIS to determine a distance, the pilot's "on" time and destination are used to suggest a speed that will prevent a congestion conflict in the harbor. This same travel clock is assigned to the ship when it moves from one dock to another dock.

Dock Clock

When a ship reaches its first assigned dock, or terminal, the travel clock is removed, and a dock clock is assigned to the ship. The dock clock is used to trigger updated alerts as to the time the ship is spending at each dock. A history of dock time is archived, and is used to determine which ships have a tendency for longer dock times. This history is intended to improve movements of ships that seem to develop a pattern of longer dock times. As the ship leaves a dock, another time stamp is added to the pilot dispatch software database.

In operation, the present invention combines the PDM and the AIS systems to produce the following information, divided into three major categories: a) arrival of ships from sea, b) sailing of ships to sea, and c) shifts from dock to dock.

Referring now to FIG. 1, the method of the present invention ("the program") for handling ship arrivals, from the time the ship arrives at anchorage, until a pilot boards the ship, has the following major components.

I. Arrival of Ships (From Sea)

The method continually checks, in step 12, to see if a ship is detected in the associated AIS latitudes/longitudes ("LAT/LNGs") of the designated harbor anchorage (the area designated by the harbor pilots as a harbor holding/waiting area) on the AIS Chart. If a ship is not detected, then in step 14 the program displays and sends a security alert that no ship is detected. If a ship is detected, then in step 16 the program checks to see if the ship is listed in the PDS database as having been scheduled to arrive at that time. If the ship is not listed, then in step 14 the program displays and sends a security alert to that effect.

If the ship is listed in the PDS database, then in step 18 the program creates the harbor anchorage in the AIS software as a waypoint, and also signals the pilot dispatch software that the ship has arrived at the harbor anchorage. The pilot dispatch software then alerts the dispatcher, and starts coordinating pilot availability, restrictions, destination, and compares the AIS ship information with the pilot dispatch software database. The program preloads a dispatcher pilot dispatch screen (i.e., it adds ship data from the PDS database to the user screen), displays an AIS-vector map with an icon of the ship, and flags discrepancies in information between the agent order information, the pilot dispatch software database, and the AIS information. Additionally, the program color codes a new ship record on the PDS dispatch and user screens.

In step 18 the program also begins the Anchorage Clock, associates the ship with the Anchorage Clock, time stamps the Anchorage arrival to the PDS database. Then, the program starts a continuous time sequence while ship is in anchorage, records the timed anchorage history, and queries the timed history to compare the ship average with the anchorage times. The program also starts timed alerts as follows: when the ship has arrived from sea to anchorage, it starts an eight-hour "to respond" timer, and begins sending anchorage status and schedule alerts each hour.

In step 20 the program identifies the ship by comparing the AIS MMSI number to the PDS IMO (Lloyds) number. In step 22 the program verifies whether the ship name, length, and beam are identical in both the MMSI and the IMO databases. If those are not identical, then in step 24 the program displays and sends a security alert. If those are items are identical, then in step 26 the program queries whether the pilot has boarded the ship. If the pilot has not boarded the ship, then in step 28 the program waits, and returns to step 26 to repeat the query.

The dispatcher inputs the pilot's boarding time to the pilot dispatch software database as it is relayed by the boarded pilot. When the pilot has boarded the ship, then in step 30 the program records this boarding time, and then sends an alert to the maritime service industry via e-mail when the pilot has boarded. This time data alerts the maritime industry that the ship is about to move. In an alternate embodiment, the time alert appears on the computers of those who are linked to the software of the present invention.

Figure 2:
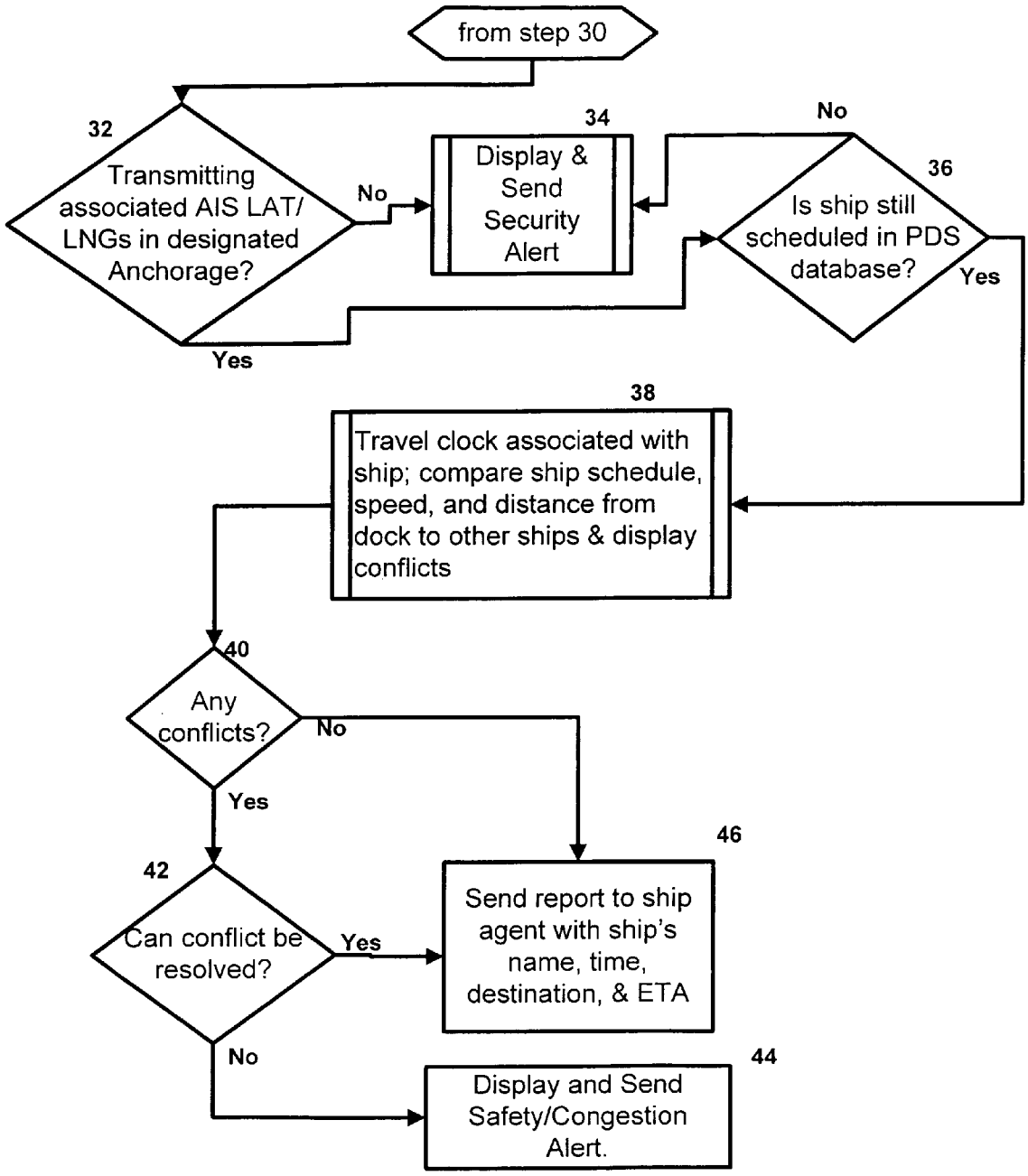
FIG. 2 is a flowchart showing the steps of the method of the present invention from the time the ship leaves the anchorage, until it arrives at a terminal.

Referring now to FIG. 2, the steps of the present method, once the ship leaves the anchorage, are shown. In step 32 the program queries whether the ship has continued to transmit associated AIS LAT/LNGs in the designated Anchorage on the AIS Chart. If it has not, then in step 34, the program displays and sends a security alert. If it has continued to properly transmit, then in step 36 the program queries whether the ship has continued to stay scheduled in the PDS database. If it has not, then in step 34 the program displays and sends a security alert.

If the ship is still scheduled, then in step 38 the program removes the anchorage clock, and starts a travel clock. The program reads the PDS database schedule information of the ship, and reads the AIS speed and distance from the HAS database. The program then calculates the ETA to the ship's destination, and displays it to the HAS screen. In step 38, the program compares the ship's schedule, speed, and distance from the dock to other ships in the PDS and HAS databases, and displays conflicts to the HAS screen. The program also compares calculated ship passing at designated waypoints, and suggests a no-congestion speed, displays the ETA, and displays any congestion conflict. Also in step 38, the program associates the ship with the travel clock in the following ways: it time stamps the beginning of travel to the HAS database, records timed history of travel to the HAS database, queries the timed history for similar movements, and queries the timed history for differences in movements.

In step 40, the program queries whether there are any conflicts. If there are conflicts, then in step 42 the program queries whether the conflict can be resolved. If the conflict can not be resolved, then in step 44 the program displays and sends a safety/congestion alert. If there are no conflicts, or if the conflicts can be resolved, then in step 46 the program sends a report to the ship's agent with the ship's name, time, destination, and ETA.

The direction of the ship is designated by the ship icon position on the AIS-vector map. The speed over ground and distance are used to calculate time to destination (ETA). The destination is pulled from the pilot dispatch software database. Users of the method of the present invention can create waypoints on the AIS-vector map. Users are alerted as to when the ship passes the waypoint, either by their using the software of the present invention, and/or by e-mail generated by the software of the present invention. When the waypoints are triggered the following information is displayed and/or e-mailed: Ship name, Time of Waypoint passage, Destination, Estimated time to destination (ETA), and a report of on-time or delayed. Waypoints are important so that the maritime service industry can set alerts as to how far the ship is from the dock, so as to be prepared for its arrival.

Figure 3:
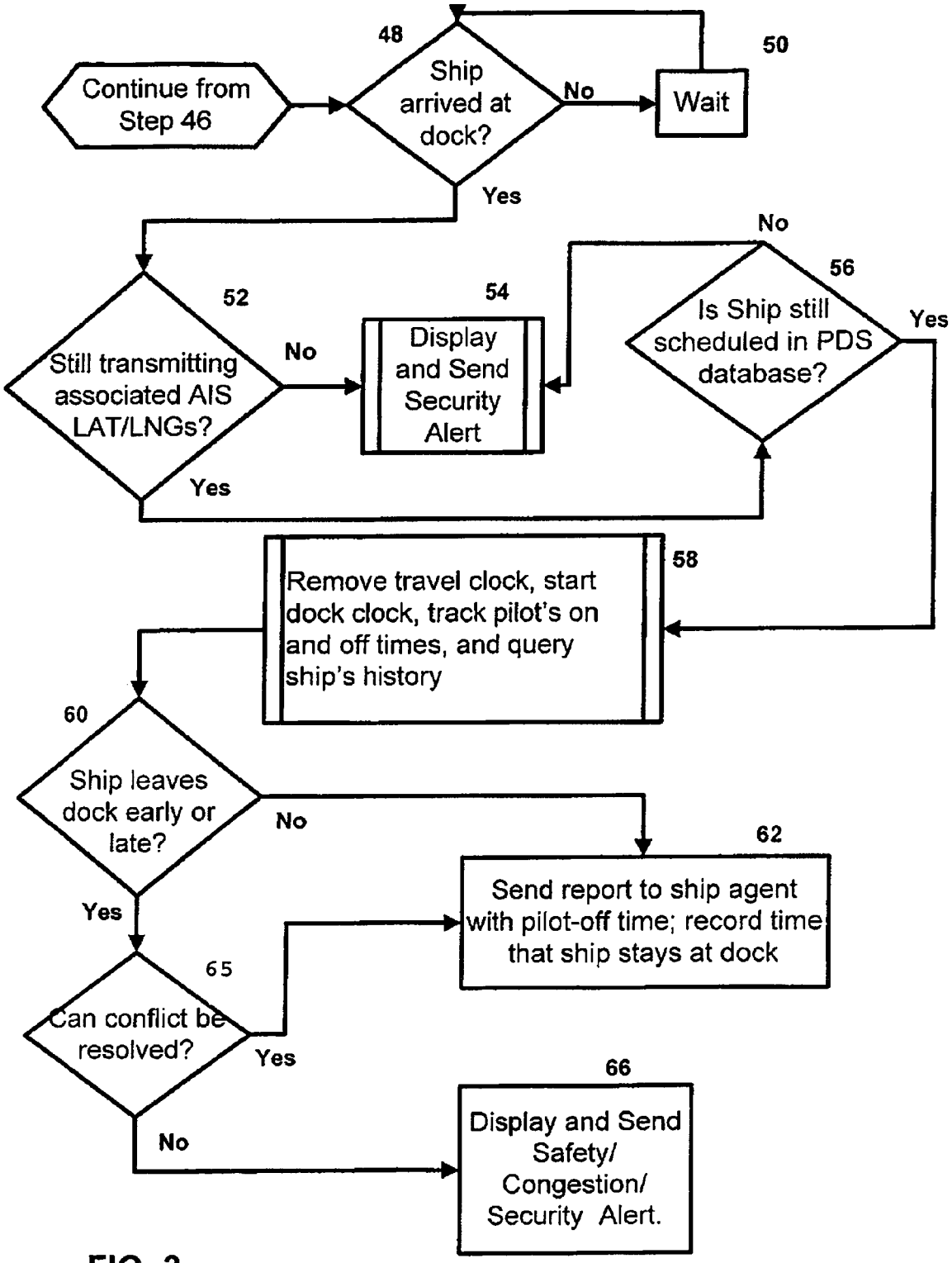
FIG. 3 is a flowchart showing the steps of the method of the present invention from the time the ship arrives at a terminal, until the pilot disembarks from the ship.

Referring now to FIG. 3, the steps of the present method, once the ship arrives at a dock, are shown. In step 48, the program queries whether the ship has arrived at the dock. If it has not yet arrived, then in step 50 the program waits, and then returns to step 48. If the ship has arrived, then in step 52 the program queries whether the ship has continued to transmit the associated AIS LAT/LNGs in the Harbor on the AIS Chart. If the ship has not continued to transmit those signals, then in step 54 the program displays and sends a security alert. If the ship has continued to transmit those signals, then in step 56 the program queries whether the ship has continued to stay scheduled in the PDS database. If it has not, then the program returns to step 54, and displays and sends a security alert. If the ship is still scheduled, then in step 58 the program removes the travel clock, starts a dock clock associated with the ship, and displays the LAT/LNG coordinates of the dock (the terminal). Additionally, the program sends an alert when the ship enters or leaves the AIS LAT/LNG of the dock, and whenever the pilot boards or leaves the ship.

The program starts a continuous time sequence while the ship is at dock, and issues time stamps for: 1) AIS LAT/LNG arrival to dock in HAS database, 2) Pilot Off time in HAS database, 3) AIS ship LAT/LNG movement from dock in HAS database, and 4) Pilot On time to HAS database. The program also records the history of the ship's time at the dock, queries the history of the ship's berths at that dock, and queries the history of the time that ship is at that particular dock. When the program sends an alert that the ship is at the terminal via AIS, it displays and/or e-mails AIS information triggered LAT/LNG coordinates that ship is at terminal. This does not mean that the ship has been moored. Thus, the maritime service industry is given advance warning that the ship is about to be moored.

Referring now to step 60, the program queries whether the ship leaves the dock early or late of the scheduled time. If the ship left in a timely fashion, then in step 62 the program sends a report to the ship agent with the pilot-off time, and records the time that the ship stays at the dock. If the ship left early or late, then in step 65 the program queries whether the conflict can be resolved. If the conflict can be resolved, then the program returns to step 62. If the conflict can not be resolved, then in step 66 the program displays and sends a safety/congestion/security alert. The program alert of pilot off time effects a display and/or e-mail via the pilot dispatch software of the pilot off time, which also designates moored time. When the program records the length of time that the ship is at the dock, it displays and/or e-mails the time the ship is actually at the dock (terminal) using the pilot off time and sailing scheduled time sourced from the pilot dispatch software database. The method of the present invention verifies times using changes in LAT/LNGS from the AIS data.

Figure 4:
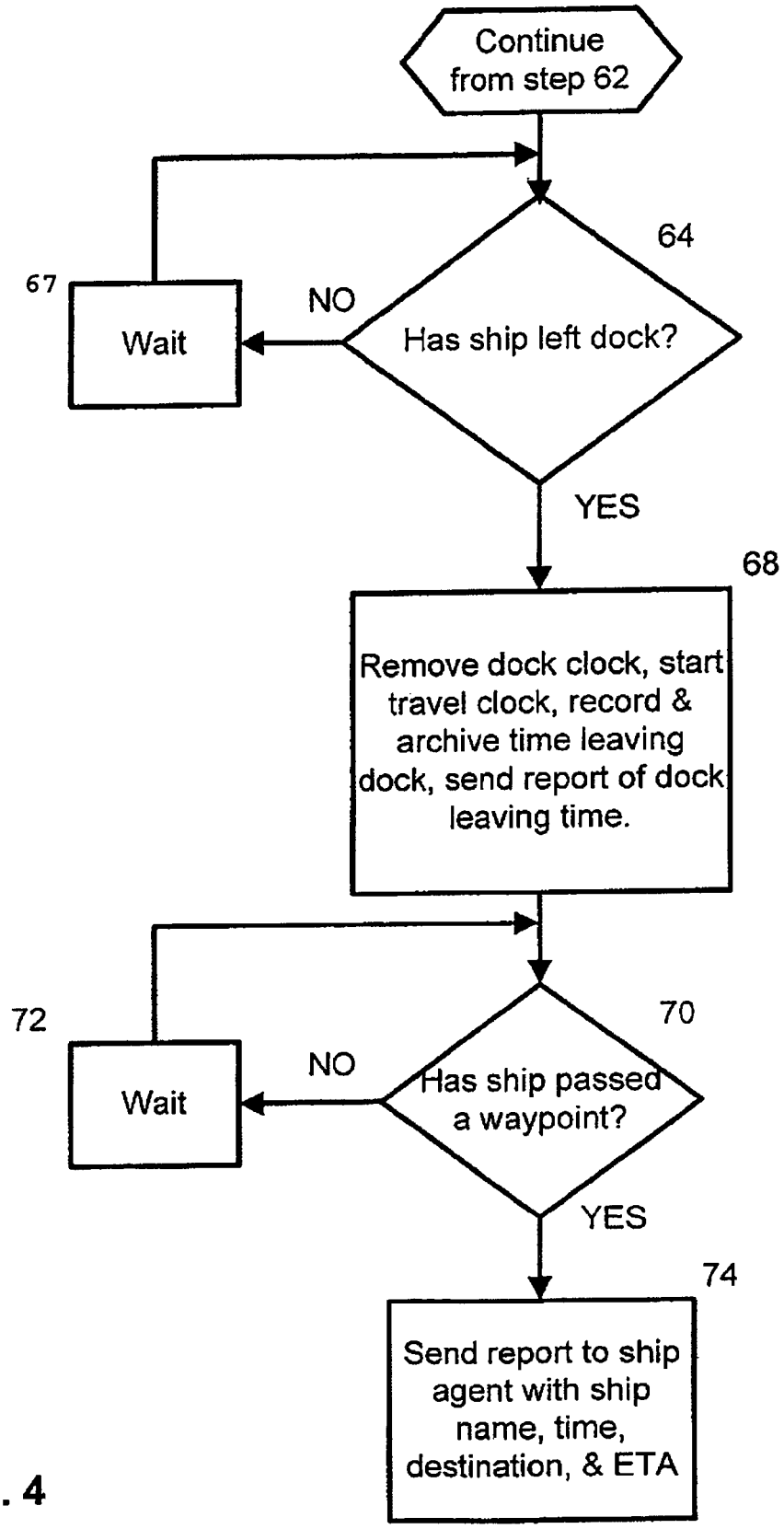
FIG. 4 is a flowchart showing the steps of the method of the present invention from the time the ship leaves the dock, until the pilot disembarks from the ship.

Referring now to FIG. 4, the steps of the present method, once the ship leaves the dock, are shown. In step 64 the program queries whether the ship has left the dock. The program uses changes in LAT/LNGS from the AIS data to determine when a ship has left its dock. If it has not left, then in step 67 the program waits, and returns to step 64 to issue the query later. If the ship has left, then in step 68 the program removes the dock clock, starts the travel clock, records and archives the time leaving the dock, and sends a report of the dock leaving time.

In step 70 the program queries whether the ship has passed a waypoint. The program displays and/or e-mails point passing recorded information from the pilot dispatch database. Point passing is reported by the pilot upon moving outbound from the harbor. The point passing is an industry established waypoint which is used to alert the maritime services of a ship passing. If the ship has not passed a waypoint, then in step 72 te program waits, and returns to step 70 to issue the query later. If the ship has passed a waypoint, then in step 74 the program will generate an alert, which will display and/or e-mail the following information: Ship name; Time of Waypoint passage; Destination; Estimated time to destination; and Report on-time or delayed.

Similarly, users can create waypoints on the AIS/Scheduling map. Users are alerted as to when the ship passes the waypoint, either by their using the software of the present invention, and/or by e-mail generated by the software of the present invention. When the waypoints are triggered, the following information is displayed and/or e-mailed: Ship name; Time of Waypoint passage; Destination; Estimated time to destination; and Report on-time or delayed.

Figure 5:
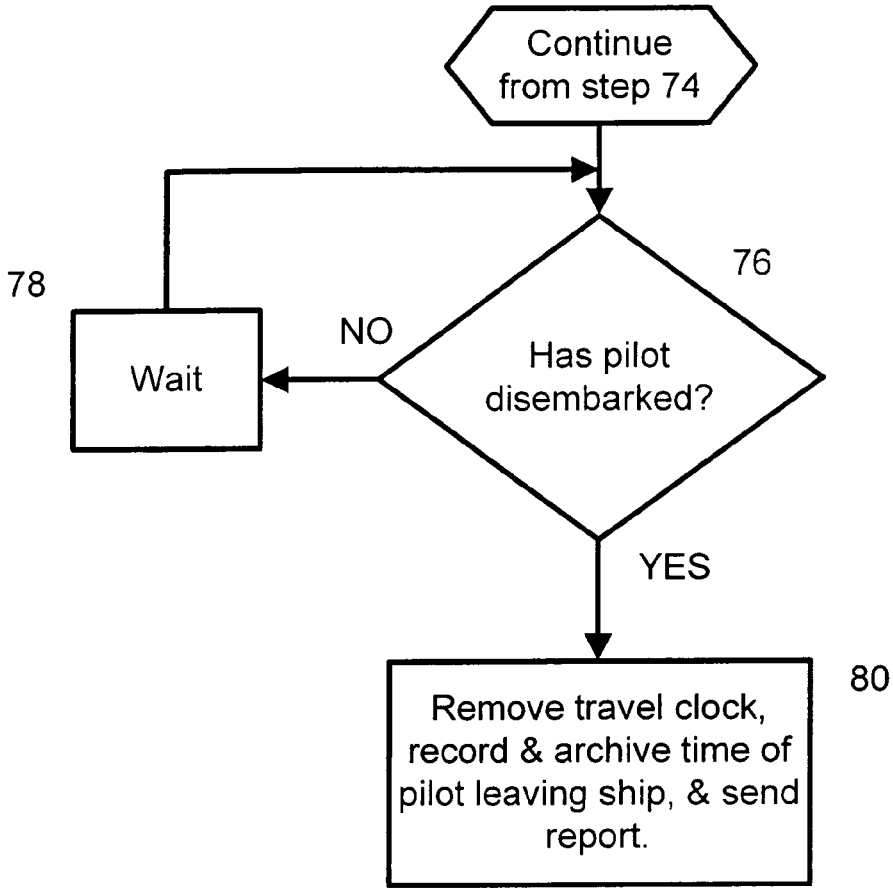
FIG. 5 is a flowchart showing the steps of the method of the present invention once the pilot disembarks from the ship.

Referring now to FIG. 5, the steps of the present method, once the pilot disembarks from the ship, are shown. In step 76 the program queries whether the pilot has disembarked from the ship. If he has not, then in step 78 the program waits, and returns to step 76. If the pilot has disembarked, then in step 80 the program removes the travel clock, records and archives the time of the pilot leaving the ship, and sends a report. The pilot-off alert displays and/or e-mails to the maritime industry that the ship has left the harbor. This information is sourced from the pilot dispatch software database.

The steps of the method of the present invention for shifts from dock to dock are essentially the same as those shown in FIGS. 2-5. The Alert pilot on displays and or/e-mails that the pilot has boarded the ship. This alert is sourced from the pilot dispatch database. The Alert ship-off-dock displays and or/e-mails AIS changes in LAT/LNGS. The Alert pilot-off displays and or/e-mails that the pilot is off the ship. This is sourced from the pilot dispatch database. For the Alert time-to-destination, the user can right-click an AIS ship target and select Estimate Time of Arrival. The user can enter in a dock name or select from a list of docks in the harbor. This alert displays and or/e-mails ETA between waypoint and destination.

A predefined list of LAT/LNGs that follow the contours of the harbor are in the HAS database. The real time AIS LAT/LNG of the selected ship is matched to predefined stored LAT/LNGs in the HAS database. The selected dock has a predefined LAT/LNG in the HAS database. HAS pulls the sequential predefined LAT/LNGs between the AIS ship target and the selected dock. The combined LAT/LNGs are converted into distance multiplied by the AIS speed, and the ETA is displayed in a pop-up window. The ETA is accurate to the harbor contours because the predefined LAT/LNGs (Vectorized) are used to follow the harbor path.

The invention claimed is:

1. A method of scheduling ships entering and leaving a harbor comprising the steps of:

a. combining information about each ship from an automated identification system with scheduling information about each ship from a pilot dispatching system to produce combined ship ID/schedule data for each ship;

b. tracking the latitude and longitude of each ship using GPS and using the automated identification system to produce a tracked latitude and longitude of each ship;

c. comparing the tracked latitude and longitude of each ship to existing maps of the harbor; and d. continually comparing the schedule data for each ship with the tracked latitude and longitude of each ship to verify the ship ID.

2. The method of claim 1, further comprising the step of sending alerts whenever the tracked latitude and longitude of each ship does not match the combined ship ID/schedule.

3. The method of claim 1, further comprising recording and displaying the times when a pilot boards the ship at anchorage, when the pilot disembarks from the ship at a dock, when a pilot boards the ship at the dock, and when a pilot disembarks from the ship at anchorage.

4. The method of claim 3, further comprising digitally fusing and displaying multiple tracks of ships in the harbor with a digital map of the harbor, and displaying a menu of automated identification system and dispatch scheduling from a common database of each ship onto the display.

5. The method of claim 1, further comprising recording and displaying the pilot relayed times when a pilot boards the ship, and when a pilot disembarks from the ship.

6. The method of claim 5, further comprising digitally fusing and displaying multiple tracks of ships in the harbor with a digital map of the harbor, and displaying a menu of identification data of each ship onto the display.

* * * * *